US008884145B1

(12) United States Patent
Lin

(10) Patent No.: US 8,884,145 B1
(45) Date of Patent: Nov. 11, 2014

(54) PERCUSSION DEVICE FOR CAJON

(71) Applicant: E Bin Industrial Co., Ltd., Taichung (TW)

(72) Inventor: Hsi-Tan Lin, Taichung (TW)

(73) Assignee: E Bin Industrial Co., Ltd., Taichung (TW)

( * ) Notice: Subject to any disclaimer, the term of this patent is extended or adjusted under 35 U.S.C. 154(b) by 0 days.

(21) Appl. No.: 14/058,356

(22) Filed: Oct. 21, 2013

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
CPC ..... G10D 13/006
See application file for complete search history.

(56) References Cited

U.S. PATENT DOCUMENTS 3,618,441 A * 11/1971 Fearns ..... 84/422.1
3,967,523 A * 7/1976 Currier et al. ..... 84/422.1
3,994,197 A * 11/1976 Bills ..... 84/418
4,026,185 A * 5/1977 Migirian ..... 84/411 R
4,747,333 A * 5/1988 Hoshino ..... 84/422.1
4,945,803 A * 8/1990 Norwood ..... 84/422.1
5,267,500 A * 12/1993 Lombardi ..... 84/402
5,458,039 A * 10/1995 Ashby ..... 84/422.1
7,365,258 B1 * 4/2008 Lombardi ..... 84/422.1
7,692,083 B2 * 4/2010 Aspland ..... 84/415
8,624,097 B1 * 1/2014 Liao ..... 84/422.1
2007/0234876 A1 * 10/2007 Veiga ..... 84/422.1
2013/0276617 A1 * 10/2013 Gunter ..... 84/422.1

FOREIGN PATENT DOCUMENTS

DE 202010004042 U1 * 7/2010
DE 202013006328 U1 * 10/2013
JP 3158678 U * 4/2010

* cited by examiner

*Primary Examiner* — Robert W Horn
(74) *Attorney, Agent, or Firm* — Wang Law Firm, Inc.; Li K. Wang; Stephen Hsu

(57) ABSTRACT

A percussion device of a cajon includes a base with a bottom plate, two upright columns on the same side of the bottom plate, a pedal pivotally coupled to the bottom plate, a pivot horizontally pivoted to the top of the two upright columns, a hammer fixed to an outer segment of the pivot, a restoring tension spring for restoring the position of the pivot after rotation, a link member coupled between first and second ends of the pedal. When the second end of the pedal is stepped downward, the first end is warped to link the link member to rotate the pivot while stretching the restoring tension spring, and the hammer swings with the rotation of the pivot. After the pedaling force disappears, the restoring tension spring pulls the pivot to rotate and link the link member to swing the first end downward and restore its original position.

10 Claims, 7 Drawing Sheets

PERCUSSION DEVICE FOR CAJON

FIELD OF THE INVENTION

The present invention relates to an accessory of a percussion musical instrument, and more particularly to a percussion device of a cajon.

BACKGROUND OF THE INVENTION

With reference to FIG. 7 for a conventional percussion device of a cajon, the device comprises a percussion element 91, a pedal element 92, and a wire 93 coupled between the percussion element 91 and the pedal element 92. When the percussion device is used for tapping the cajon 94, the percussion element 91 is placed in the front of a tapping surface 941 of the cajon 94, and the percussion element 91 is arranged on a side of the cajon 94. During use, a user sits on the cajon 94 and sets a leg on the pedal element 92. By stepping on a pedal 921 of the pedal element 92, the wire 93 affects a pivot 911 of the percussion element 91 to rotate and drive a hammer 912 of the percussion element 91 to hit on the tapping surface 941, so that the cajon 94 can produce sounds. Compared with the conventional way of tapping the cajon by palms, the tapping of the cajon 94 by hands is substituted by the percussion element 91, so that the user's hands are available for other purposes, and the use of the cajon for accompaniment becomes more flexible.

However, the percussion element 91 and the pedal element 92 of the percussion device are installed separately and linked by the wire 93. Although the movement of the pedal element 92 can tap the cajon by linking the wire 93 to the percussion element 91, yet the components are relatively complicated and incur a relatively high cost. In addition, the percussion element 91 and the pedal element 92 are installed separately, and thus having the problem of inconvenience to carry.

Therefore, it is a main point of the present invention to overcome the aforementioned problems of the conventional percussion device of a cajon.

SUMMARY OF THE INVENTION

In view of the aforementioned shortcomings of the prior art, it is a primary objective of the present invention to overcome the shortcomings by providing a percussion device of a cajon with the advantages of simplified components, low cost, and convenient to carry.

To achieve the aforementioned objective, the present invention provides a percussion device of a cajon comprising: a base, including a bottom plate and two upright columns, and the two upright columns being disposed on the same side of the bottom plate; a pedal, having a first end and a second end disposed apart from each other, and a position between the first end and the second end being pivoted onto the bottom plate, and the first end being proximate to the two upright columns; a pivot, horizontally pivoted to the top of the two upright columns, and including an inner segment disposed between the two upright columns and an outer segment extended out from the upright column; a hammer, fixed to the outer segment of the pivot; a restoring tension spring, with an end coupled to the base, and the other end coupled to the pivot, for driving the pivot to restore its original position after being rotated; a link member, coupled between the first end of the pedal and the pivot, and limited by the rotation of the pivot to control the first end of the pedal to be normally swung downward and the second end of the pedal to be normally warped; such that when the second end is stepped to swing downward, the first end is warped to link the link member and pull the pivot to overcome the limitation and rotate, while stretching the restoring tension spring, and the hammer pivotally swings towards the tapping direction together with the rotation of the pivot; and the restoring tension spring pulls the pivot to rotate when the pedaling force disappears, and links the link member to control the first end to swing downward and restores its original position.

DESCRIPTION OF THE PREFERRED EMBODIMENTS

The technical characteristics of the present invention will become clearer in light of the following detailed description of illustrative embodiments of this invention. It is intended that the embodiments as disclosed in FIGS. 1 to 6 are to be considered illustrative rather than restrictive.

Figure 1:
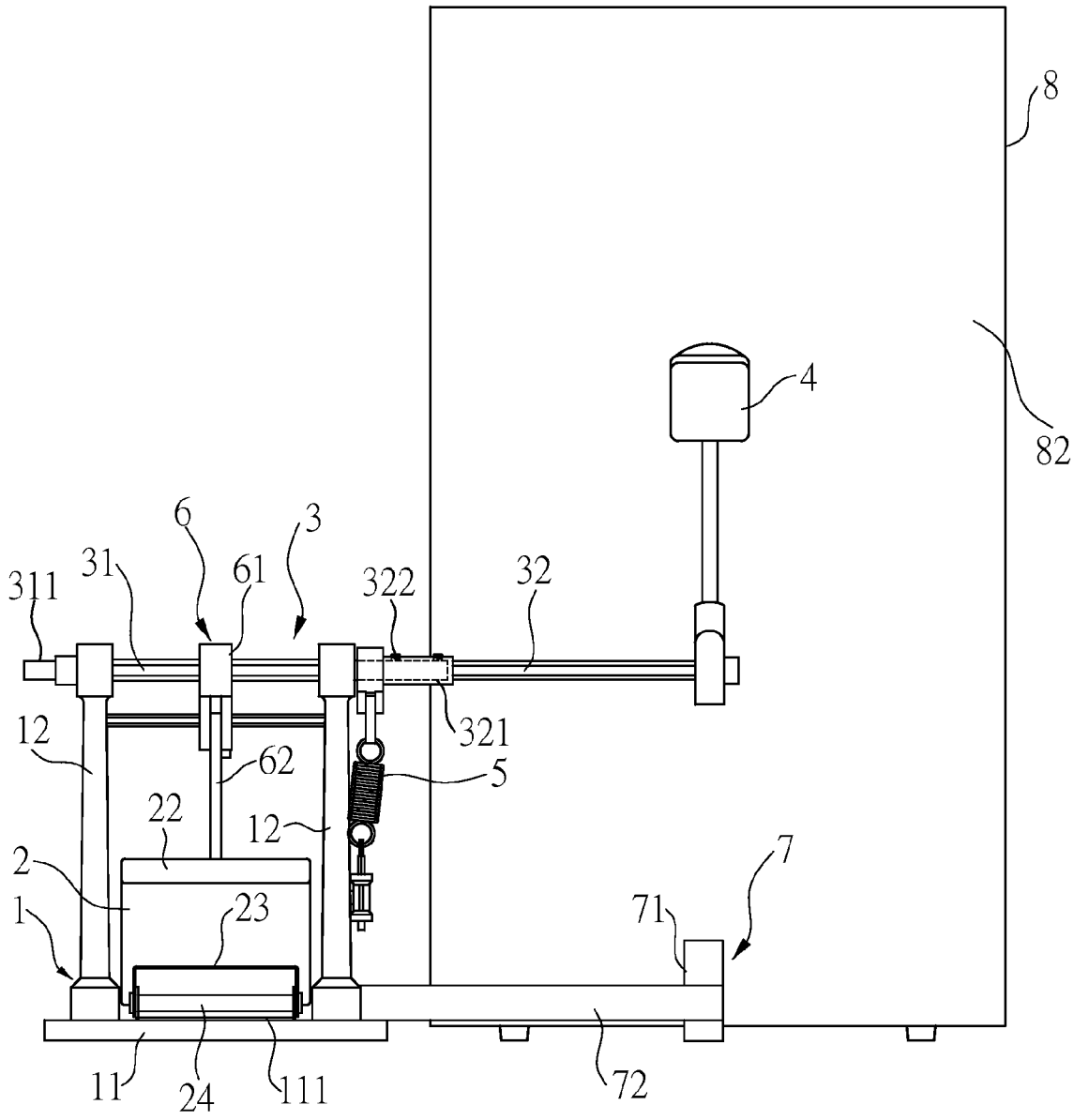
FIG. 1 is a side view of a percussion device in accordance with a first preferred embodiment of the present invention.

With reference to FIG. 1 for a percussion device of a cajon in accordance with a preferred embodiment of the present invention, the percussion device is provided for tapping a tapping surface of the cajon, and the percussion device comprises a base 1, a pedal 2, a pivot 3, a hammer 4, a restoring tension spring 5 and a link member 6.

Figure 2:
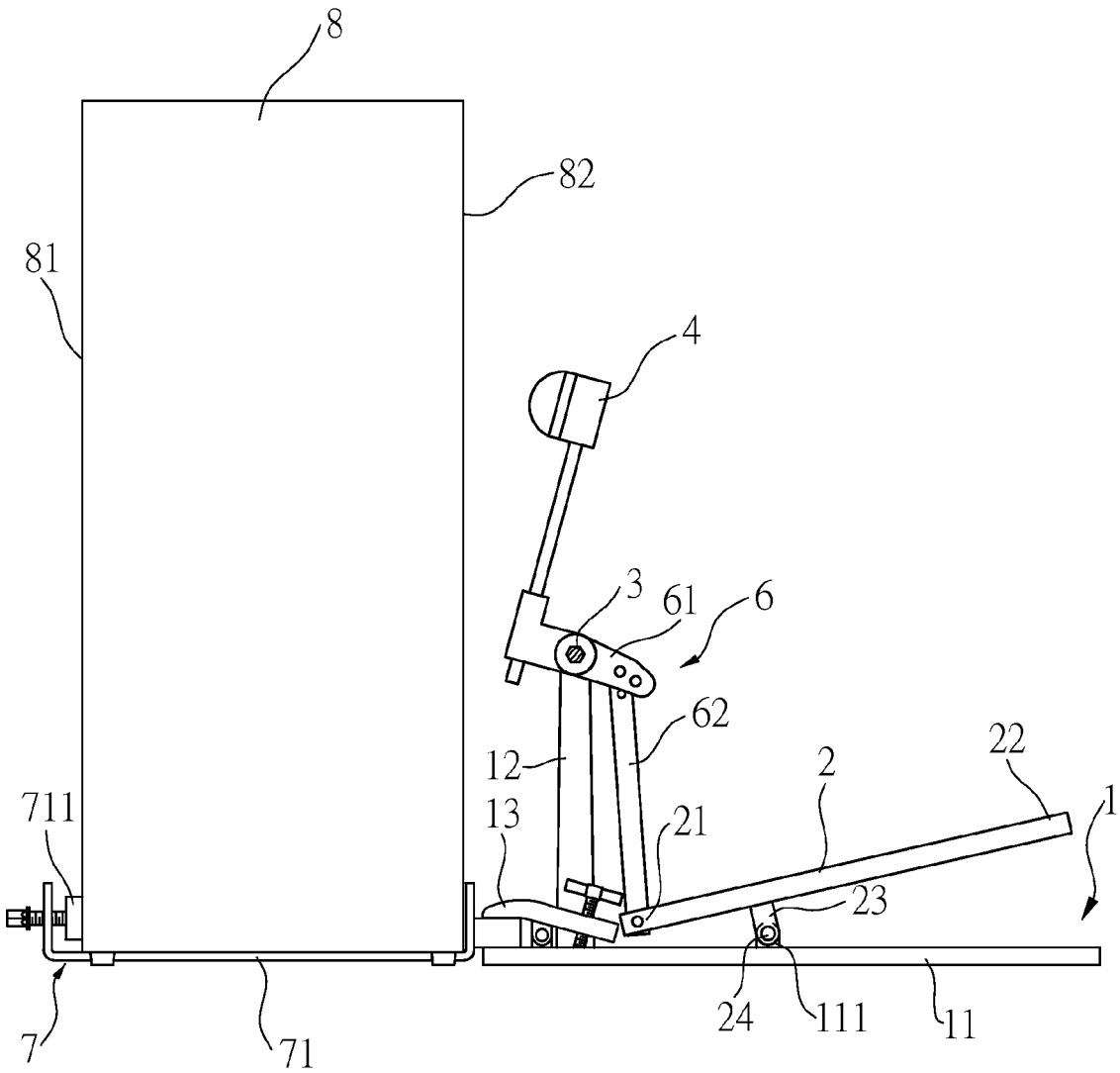
FIG. 2 is another side view of a percussion device in accordance with the first preferred embodiment of the present invention.

In FIGS. 1 and 2, the base 1 includes a bottom plate 11 and two upright columns 12, and the two upright columns 12 are disposed on the same side of the bottom plate 11.

In FIGS. 1 and 2, the pedal 2 has a first end 21 and a second end 22 disposed apart from each other, and a position between the first end 21 and the second end 22 is pivotally coupled to the bottom plate 11, and the first end 21 is proximate to the two upright columns 12. In this preferred embodiment, the bottom plate 11 includes a U-shaped first hinge 111, and the bottom of the pedal 2 has an inverted U-shape second hinge 23 disposed between the first end 21 and the second end 22, and the second hinge 23 and the first hinge 111 are pivotally coupled by a shaft member 24 to pivot the pedal 2 to the bottom plate 11.

In FIGS. 1 and 2, the pivot 3 is horizontally pivoted to the top of the two upright columns 12, and the pivot 3 includes an inner segment and an outer segment, wherein the inner segment is disposed between the two upright columns 12, and the outer segment is extended out from the upright column 12, and the hammer 4 is fixed to the outer segment of the pivot 3. In this preferred embodiment, the inner segment of the pivot 3 is the first rod 31, and the outer segment is the second rod 32, wherein the first rod 31 is pivotally installed between the two upright columns 12, and a protrusion 311 is formed at both ends of the first rod 31 and protruded from the two upright columns 12, and a sleeve portion 321 is disposed at an end of the second rod 32 away from the hammer 4 for selectively sheathing on any one of the protrusions 311 at both ends of the first rod 31, and a locking member 322 is provided for locking the sheathing the protrusion 311 sheathed by the sleeve portion 321, so that the position of the hammer 4 can be switched between both sides of the pivot 3.

In FIGS. 1 and 2, an end of the restoring tension spring 5 is coupled to the base 1 and the other end is coupled to the pivot 3, and the restoring tension spring 5 is provided for restoring the original position of the pivot 3 after the pivot 3 is rotated. In this preferred embodiment, the restoring tension spring 5 coupled to an end of the base 1 is also coupled to an external side of one of the upright columns 12, and the restoring tension spring 5 coupled to an end of the pivot 3 and disposed on an external side of the upright column 12 is also coupled to the protrusion 311 of the first rod 31. In a different implementation mode, an end of the pivot 3 disposed on the external side of the upright column 12 can be coupled to the second rod 32 directly.

In FIGS. 1 and 2, the link member 6 is coupled between the first end 21 of the pedal 2 and the pivot 3, and rotated together with the pivot 3 and limited, so that the link member 6 can control the first end 21 of the pedal 2 to be swung downward normally and the second end 22 of the pedal 2 to be warped normally.

In FIGS. 1 and 2, the link member 6 of this preferred embodiment includes a swing arm 61 and a link rod 62, wherein an end of the swing arm 61 is fixed to the pivot 3, and the other end of the swing arm 61 is stretched towards the pedal 2 and pivotally coupled to an end above the link rod 62, and an end below the link rod 62 is pivotally coupled to the pedal 2. In this preferred embodiment, the rotation of the pivot 3 is pulled by the restoring tension spring 5 and limited, and the second end 22 is stepped to swing downward to overcome the tension of the restoring tension spring 5, so as to rotate the pivot 3.

In FIGS. 1 and 2, this preferred embodiment further comprises a bracket 7 having an inverted U-shape frame 71, a propping member 711 disposed at an end of the frame 71, and a shaft 72 is installed at an end of the frame 71 away from the other end of the propping member 711, and the shaft 72 is perpendicular to the frame 71 and extended laterally. In FIG. 2, the bottom of the cajon 8 is disposed in the frame 71, and the propping member 711 is provided for abutting the back 81 of the cajon 8 against the frame 71 for a fixation, and the shaft 72 is extended laterally from the tapping surface 82 of the cajon 8 and provided for fixing the base 1 to a position adjacent to the cajon 8. In this preferred embodiment, the bottom plate 11 of the base 1 has a clamp 13 installed on a side of the two upright columns 12 and clamped to the shaft 72 to fix the base 1 at a position adjacent to the cajon 8.

Figure 3:
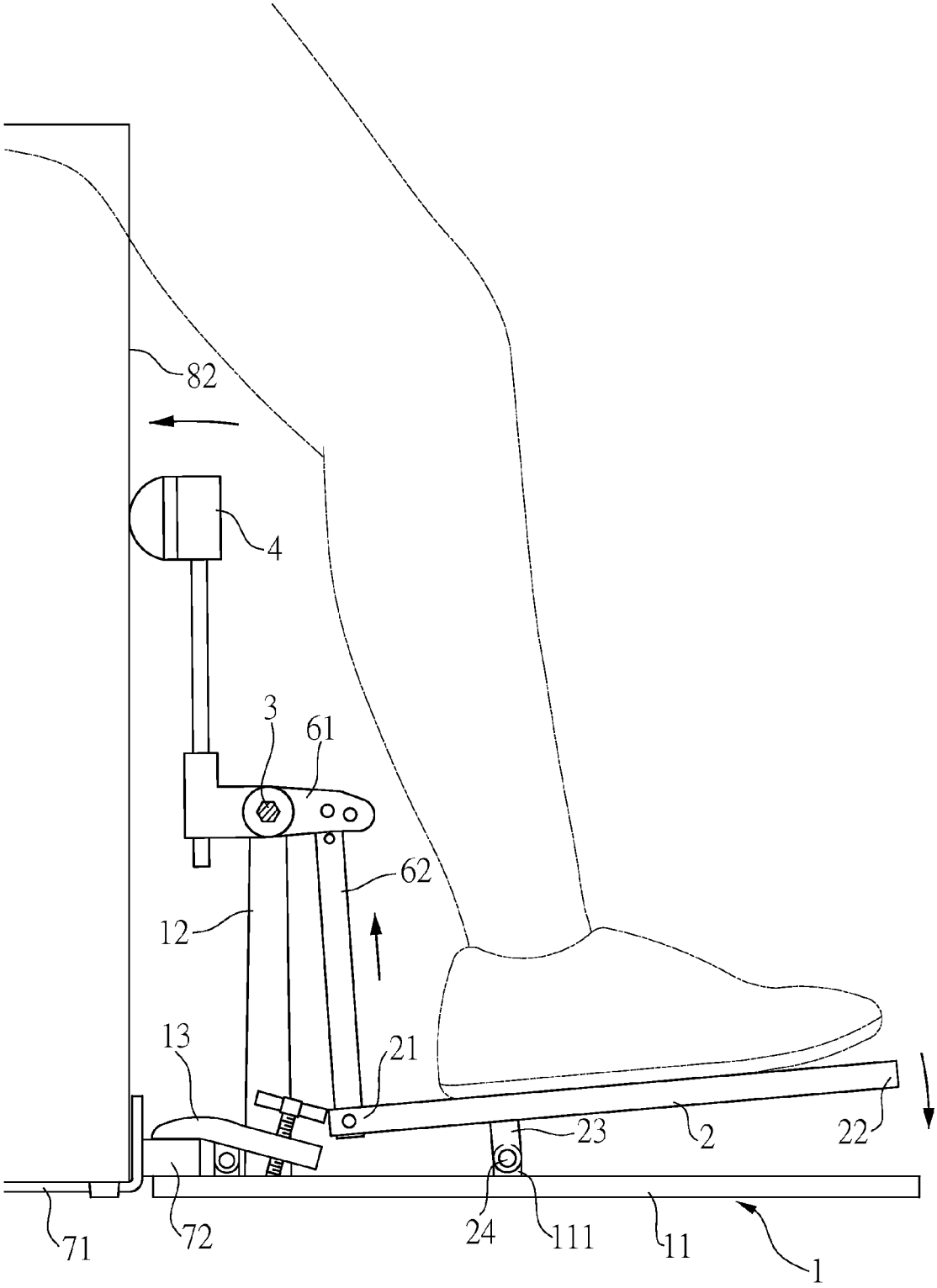
FIG. 3 is a schematic view of a using status of a percussion device in accordance with the first preferred embodiment of the present invention.

In an actual use as shown in FIG. 3, the second end 22 of the pedal 2 is stepped to swing downward. Now, the first end 21 is warped to link the link member 6 to control the pivot 3 to overcome the limitation of the restoring tension spring 5 and rotate the pivot 3. In the meantime, the restoring tension spring 5 is stretched, so that the link rod 62 is linked to move upward when the first end 21 is warped, and the swing of the swing arm 61 controls the pivot 3 to rotate, and the hammer 4 is swung pivotally in the tapping direction with the rotation of the pivot 3. The tapping direction refers to the tapping direction of tapping the tapping surface 82 of the cajon 8. When the pedaling force disappears, the restoring tension spring 5 pulls the pivot 3 to rotate, and links the link member 6 to control the first end 21 to swing downward and restore its original position. When the first end 21 is swung downward, the link rod 62 is linked to move downward, so that the swing arm 61 swings reciprocally to control the pivot 3 to rotate and restore its original position.

In summation of the description above, the present invention has the following advantages: The percussion device of the present invention inverts the pedaling direction of the pedal of the conventional percussion device and the pedaling direction of the pedal 2 of the invention. In other words, the installation position of the pivot of the conventional percussion device is generally installed in the normally warped end of the pedal, but the installation position of the pivot 3 of the present invention is installed at a normally downwardly swung first end 21 of the pedal 2, and the pivot 3 is extended out from the second rod 32 to the tapping surface 82 of the cajon 8, so that a user still can perform a stepping motion of the pedal 2 in the same way of stepping the conventional pedal by tiptoe instead of by heel, so as to avoid any inadaptability caused by different habits of use, and the hammer 4 hits in a direction of the user and towards the tapping surface 82 of the cajon 8. Compared with the conventional percussion device, the percussion device of the present invention has relatively simpler components and incurs a lower component cost, and provides a convenient carry by only one independent component.

Figure 4:
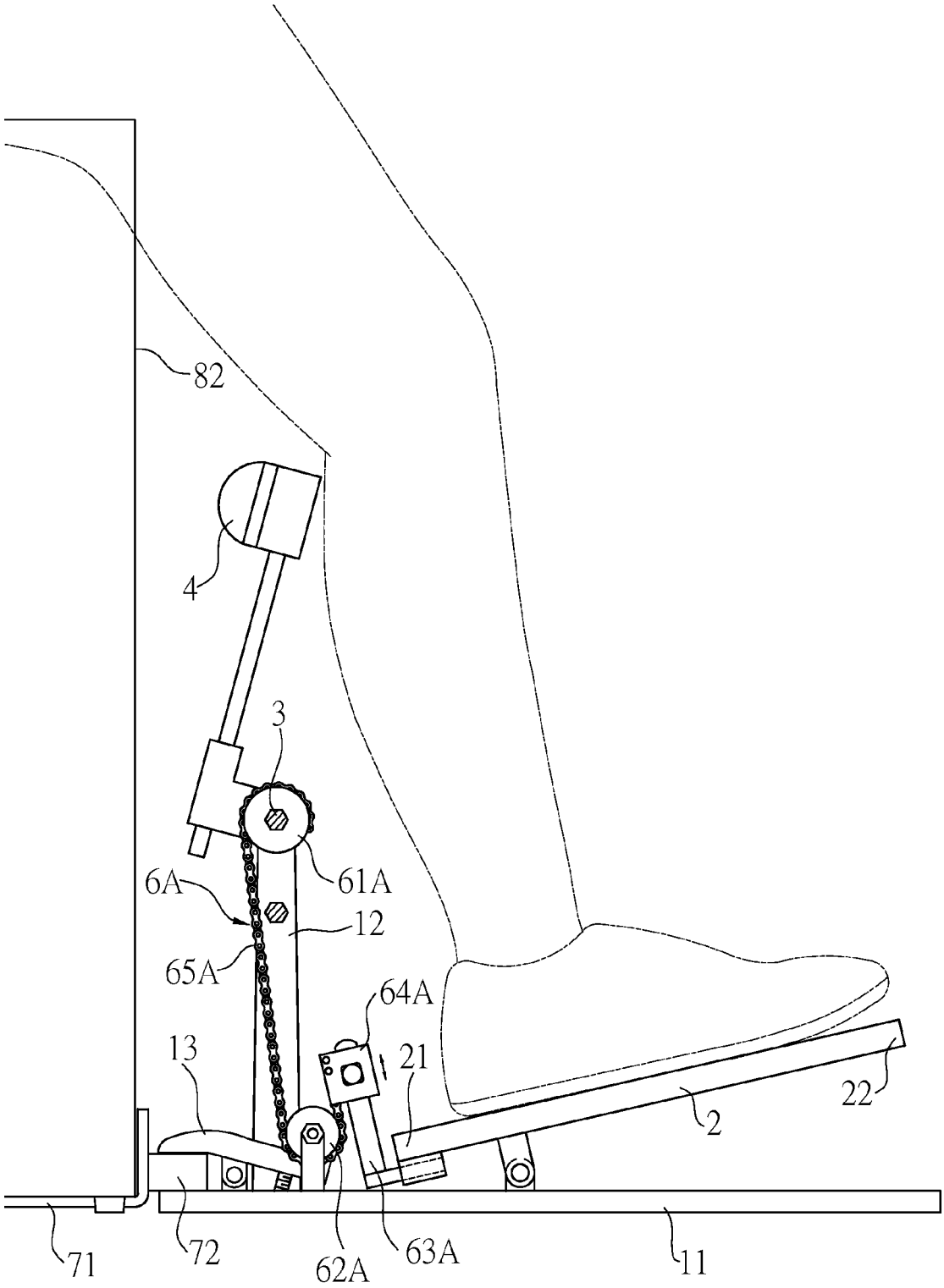
FIG. 4 is a side view of a percussion device in accordance with a second preferred embodiment of the present invention.

Of course, there are numerous embodiments of the present invention with minor modifications. With reference to FIG. 4 for the second preferred embodiment of the present invention, the second preferred embodiment is similar to the first preferred embodiment and comprises a base 1, a pedal 2, a pivot 3, a hammer 4, and a restoring tension spring (not shown in the figure), and the link member 6 of the first preferred embodiment is substituted by the link member 6A of this preferred embodiment. The link member 6A of this preferred embodiment includes an upper guide pulley 61A, a lower pulley 62A, a guide rod 63A, a sliding block 64A and a chain 65A, wherein the upper guide pulley 61A is coaxially fixed to the pivot 3, and the lower pulley 62A below the pivot 3 is fixed to the bottom plate 11 and at a position adjacent to the first end 21 of the pedal 2, and the guide rod 63A is installed at the first end 21 of the pedal 2 and erected, and the sliding block 64A is sheathed on the guide rod 63 and slid longitudinally, and a locking member 641A is provided for fixing the sliding block 64A after the sliding block 64 slides to an appropriate position, and an end of the chain 65A is coupled to the upper guide pulley 61A, and the chain 65A is wound across the lower pulley 62A and the other end of the chain 65A is coupled to the sliding block 64A. By substituting the link member 6 of the first preferred embodiment by the link member 6A of this preferred embodiment also can achieve the same effect of the first preferred embodiment. In addition, the longitudinal height of the sliding block 64A on the guide rod 63A can be adjusted, so that the amplitude of the rotation of the linked pivot 4 can be adjusted during the swing of the pedal 2.

Figure 5:
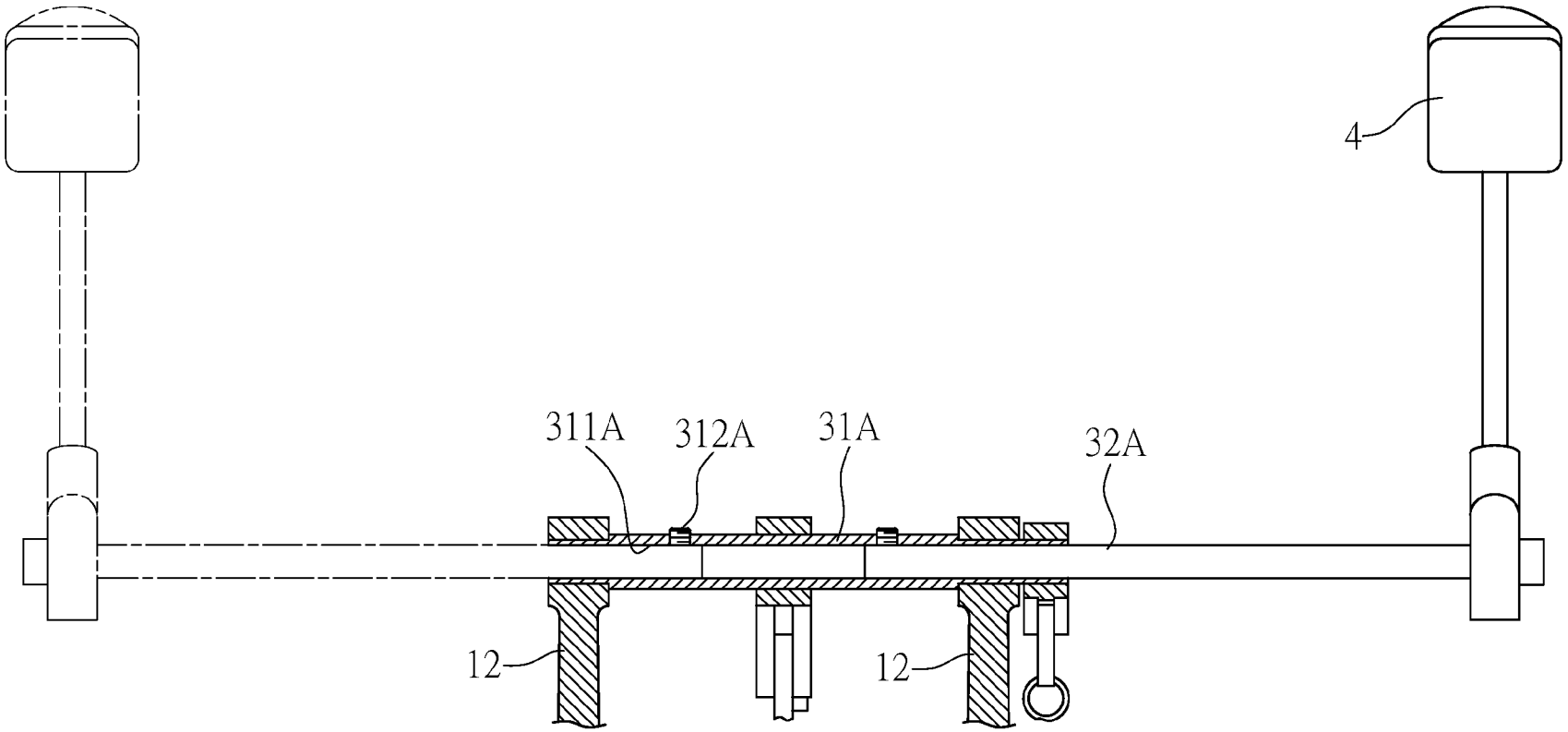
FIG. 5 is a partial blow-up sectional view of a second rod on both sides of a pivot being coupled to a first rod in accordance with a third preferred embodiment of the present invention.
Figure 6:
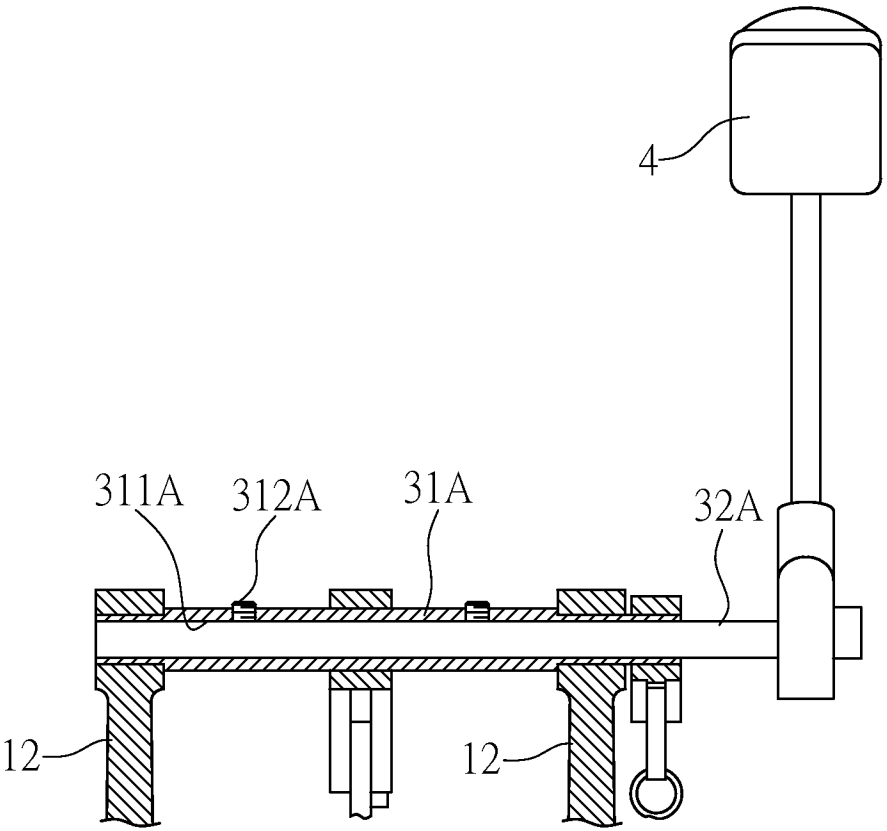
FIG. 6 is a partial blow-up sectional view of a second rod being retracted into a through hole for storage in accordance with the third preferred embodiment of the present invention.
Figure 7:
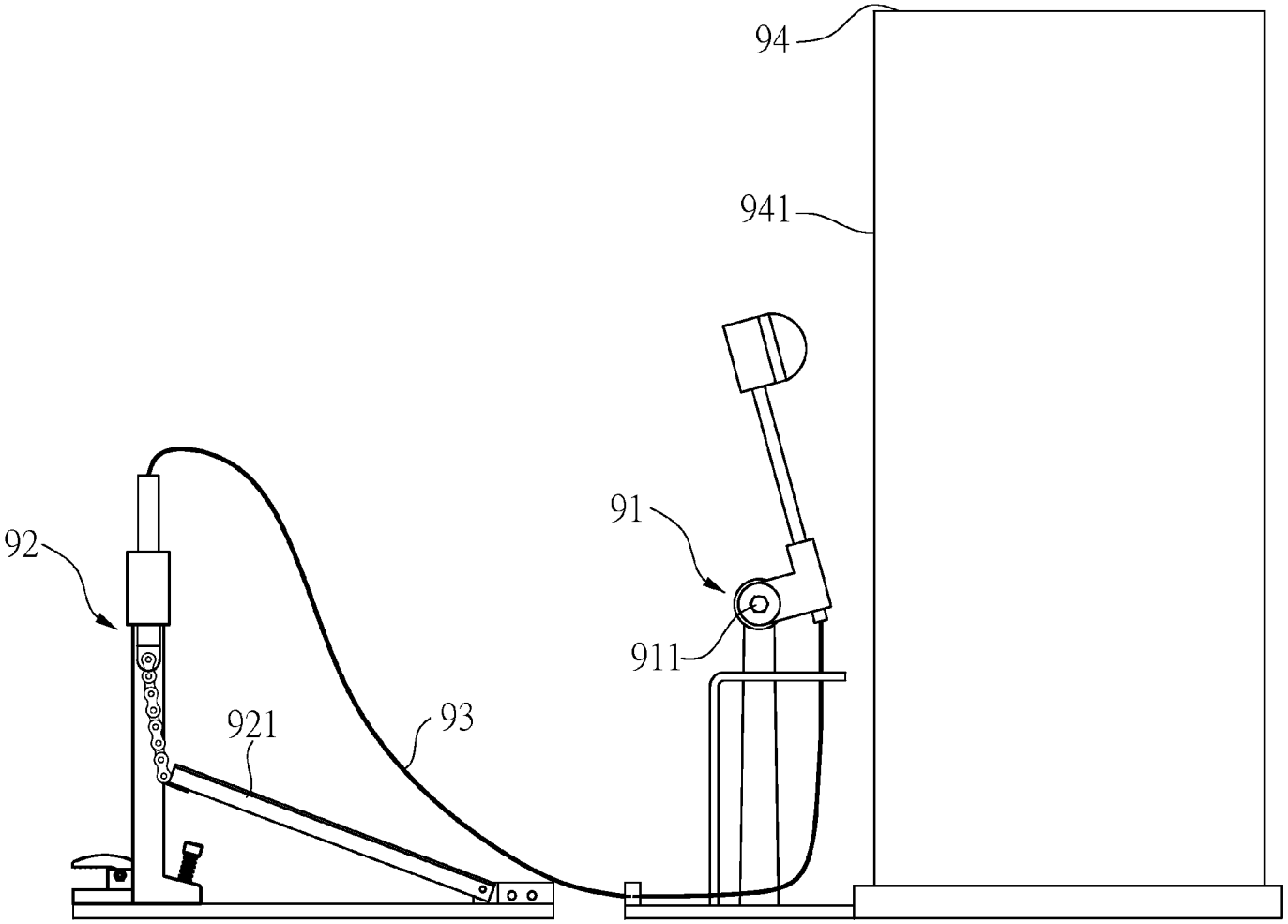
FIG. 7 PRIOR ART
FIG. 7 is a side view of a conventional percussion device.

With reference to FIG. 5 for the second preferred embodiment of the present invention, the inner segment of the pivot 3A is the first rod 31A, and the outer segment is the second rod 32A. The major difference between this preferred embodiment and the first preferred embodiment resides on that the first rod 31A is pivotally installed between the two upright columns 12, and the first rod 31A has a through hole 311A penetrating through both ends of the first rod 31A, and an end of the second rod 32A away from the hammer 4 is passed into the through hole 311A, and after the exposed length is selected, the locking member 312A above the first rod 31A locks the second rod 32A installed in the through hole 311A, so that this preferred embodiment can achieve the same effect of the pivot 3 of the first preferred embodiment, and the installation position of the hammer 4 can be switched between both sides of the pivot 3. In FIG. 6, the whole second rod 32A is retracted into the through hole 311A to shorten the extension length of the second rod 32A to facilitate storage.

What is claimed is:

1. A percussion device of a cajon, provided for tapping on a tapping surface of the cajon to produce a sound, comprising:

a base, including a bottom plate and two upright columns, and the two upright columns being disposed on the same side of the bottom plate;

a pedal, having a first end and a second end disposed apart from each other, and a position between the first end and the second end being pivoted onto the bottom plate, and the first end being proximate to the two upright columns;

a pivot, horizontally pivoted to the top of the two upright columns, and including an inner segment disposed between the two upright columns and an outer segment extended out from the upright column;

a hammer, fixed to the outer segment of the pivot;

a restoring tension spring, with an end coupled to the base, and the other end coupled to the pivot, for driving the pivot to restore its original position after being rotated;

a link member, coupled between the first end of the pedal and the pivot, and limited by the rotation of the pivot to control the first end of the pedal to be normally swung downwardly and the second end of the pedal to be normally swung upwardly;

such that when the second end is stepped upon to swing downwardly, the first end is swung upwardly to displace the link member and pull the pivot to overcome the spring tension limitation and rotate, while stretching the restoring tension spring, and the hammer pivotally swings towards the tapping direction together with the rotation of the pivot; and the restoring tension spring pulls the pivot to rotate in reverse when the pedaling force disappears, and displaces the link member to control the first end to swing downward and restores its original position.

2. The percussion device of a cajon according to claim 1, wherein the link member includes a swing arm and a link rod, and an end of the swing arm if fixed to the pivot, and the other end of the swing arm is extended towards the pedal and pivotally coupled to an end of the link rod, and an end of the link rod is pivotally coupled to the first end of the pedal.

3. The percussion device of a cajon according to claim 1, wherein the link member includes an upper guide pulley, a lower pulley, a guide rod, a sliding block and a chain, and the upper guide pulley is coaxially fixed to the pivot, and the lower pulley below the pivot is fixed to the bottom plate and disposed adjacent to the first end of the pedal, and the guide rod is installed at the first end of the pedal and erected, and the sliding block is sheathed on the guide rod and fixed after sliding longitudinally, and an end of the chain is coupled to the upper guide pulley, and the chain is wound downwardly across the lower pulley, and the other end is coupled to the sliding block.

4. The percussion device of a cajon according to claim 3, wherein the sliding block includes a locking member, and the locking member is fixed after the sliding block slides on the guide rod and to an appropriate position.

5. The percussion device of a cajon according to claim 1, further comprising a bracket having an inverted U-shape frame, a propping member disposed at an end of the frame, a shaft perpendicular to the frame, extended laterally and disposed at the other end of the frame away from the propping member, and the bottom of the cajon is disposed in the frame, and the propping member is fixed by abutting the back of the cajon against the frame and the shaft is laterally extended from the tapping surface of the cajon for fixing the base at a position adjacent to the cajon.

6. The percussion device of a cajon according to claim 5, wherein the base includes a clamp disposed on the bottom plate and on a side of the two upright columns, and the clamp is clamped to the shaft to fix the base to a position adjacent to the cajon.

7. The percussion device of a cajon according to claim 1, wherein the bottom plate includes a U-shaped first hinge, and an inverted U-shape second hinge disposed at the bottom of the pedal and between the first end and the second end, and the second hinge is pivotally coupled to the first hinge by a shaft member and pivotally installed on the bottom plate of the pedal.

8. The percussion device of a cajon according to claim 1, wherein the rotation of the pivot is pulled and restricted by the restoring tension spring, and the second end is stepped to swing downward to overcome the tension of the restoring tension spring, so as to rotate the pivot.

9. The percussion device of a cajon according to claim 1, wherein the inner segment of the pivot is the first rod, and the outer segment is the second rod, and the first rod is pivotally installed between the two upright columns, and both ends of the first rod have a protrusion protruded out from the two upright columns, and an end of the second rod away from the hammer has a sleeve portion for selectively sheathing on any one of the protrusions at both ends of the first rod, and a locking member is provided for locking the protrusion sheathed by the sleeve portion.

10. The percussion device of a cajon according to claim 1, wherein the inner segment of the pivot is the first rod, and the outer segment is the second rod, and the first rod is pivotally coupled between the two upright columns, and the first rod has a through hole penetrating both ends of the first rod, and an end of the second rod away from the hammer is passed into the through hole, and after an exposed length is selected, a locking member is provided for locking on the second rod in the through hole to the first rod.

* * * * *